US007662006B2

(12) United States Patent
Mollis

(10) Patent No.: US 7,662,006 B2
(45) Date of Patent: Feb. 16, 2010

(54) SHAPED INFLATABLE WATER SPORTS BOARD

(75) Inventor: John Mollis, New York, NY (US)

(73) Assignee: John C. Mollis

( * ) Notice: Subject to any disclaimer, the term of this patent is extended or adjusted under 35 U.S.C. 154(b) by 0 days.

(21) Appl. No.: 11/824,113

(22) Filed: Jun. 28, 2007

(65) Prior Publication Data

US 2009/0004936 A1 Jan. 1, 2009

(51) Int. Cl.
*B63B 1/00* (2006.01)

(52) U.S. Cl. ..... 441/65; 441/74; 114/357

(58) Field of Classification Search ..... 441/66, 441/74, 65; 114/357
See application file for complete search history.

(56) References Cited

U.S. PATENT DOCUMENTS 3,510,893 A * 5/1970 Moore ..... 441/30
3,577,576 A 5/1971 Lobb
3,657,753 A 4/1972 Le Blanc, Sr.
3,663,976 A * 5/1972 Momany ..... 114/357
5,351,637 A * 10/1994 Brenckmann ..... 114/39.14
6,066,016 A 5/2000 Yonover
6,131,532 A 10/2000 Winner
6,241,568 B1 * 6/2001 Simms ..... 441/74
2003/0153221 A1 * 8/2003 Weir ..... 441/66

* cited by examiner

*Primary Examiner*—Stephen Avila
(74) *Attorney, Agent, or Firm*—Bay Area IP, LLC; Ariel Bentolila

(57) ABSTRACT

A shaped inflatable water sports board is presented. The inflatable water sports board includes an airtight elongated housing having a predetermined shape. An internal structure is contained within the housing for substantially maintaining the predetermined shape when the board is inflated. An inflation valve is provided for inflating the board where when the board is inflated the board is sufficiently rigid to maintain the predetermined shape under the weight of an adult.

20 Claims, 8 Drawing Sheets

SHAPED INFLATABLE WATER SPORTS BOARD

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The field of the present invention pertains generally to buoys, rafts, and aquatic devices that are inflatable and, more specifically, surfboards. More particularly, the invention relates to a precisely shaped inflatable water sports board.

BACKGROUND OF THE INVENTION

Water sports boards, which include, without limitation, surfboards, windsurfing boards and body boards, have been around for many years and are constructed in a variety of ways and with various materials. The present disclosure is particularly concerned with surfboards. Each type of surfboard has certain advantages and disadvantages. Surfboards are constructed to address certain needs such as, but not limited to, transportability, durability, safety, and performance. The delicate balance between surfboard weight, shape, the type and number of fins, and the fin configuration determines performance.

Traditional surfboards are rigid and can be made of entirely of wood, can be a composite of a core material and outer shell, or just a hollow shell. The core is typically coated with Fiberglas®, carbon fiber composite or a variety of plastic and resin outer shells. Rigid surfboards are not normally collapsible for ease of transport and storage. However, some surfboards can be disassembled into sections for these purposes. Durability depends on the materials used and usually comes at the price of surfboard performance because of added weight, except in the case of Tuflite® surfboards. Tuflite® surfboards use a combination of lightweight EPS (Expanded Poly Styrene) foam core material with a layered PVC and Fiberglas® composite shell for strength and durability. The most common type of surfboard is a polyurethane foam core with a Fiberglas® outer shell. These boards are lightweight, sturdy, and capable of high performance. However, these boards are very susceptible to damage ("dings") and even breakage in large surf conditions. In general, rigid surfboards also suffer from safety issues. A fast moving surfboard can cause serious injury. Some rigid surfboards have been made that address safety by covering the outer shell with a soft material that cushions impacts.

A class of surfboards has emerged called soft surfboards. These boards specifically address the need for safety and durability by using softer semirigid foam as the primary material. However, these boards are mostly used by beginners and are not capable of high performance surfing.

Many attempts have also been made to address transportability, durability and safety as primary concerns. These mostly take the form of inflatable surfboards. For the purposes of this discussion, the previous approaches to inflatable surfboards are placed into two categories. Category I includes surfboards that are inflatable and derive their shape from rigid supports. Category II includes surfboards that have a single inflation chamber and keep their shape through use of flexible supports throughout the inside of the surfboard. Often this support takes the form of drop stitching.

There are some disadvantages of Category I surfboards. These surfboards are more complicated than a single collapsible board. These surfboards depend on extra rigid supports or multiple air chambers that complicate setup, transport and construction. Also, the rigid elements make these surfboards less safe to use compared to Category II surfboards which are fully flexible when deflated. Finally, Category I boards are only a rough approximation of the shape needed for skilled surfing and are not suitable for high performance surfing.

Category II surfboards overcome the complication of added rigid support and multiple air chambers. These surfboards are simpler to use and, at low inflation pressure, are safer to use. These surfboards can be easily folded and stowed away and just as easily inflated. These surfboards are durable because they rely on the same technology as rubber rafts, for example, without limitation, Neoprene® or Hypalon®, for the outer covering. Category II surfboards are designed to enable surfing and have the advantage of low weight. However, no attempt has been made to describe how they might be constructed to accurately capture the complicated shapes of modern surfboards. This is a disadvantage that precludes them from use in high performance surfing.

What has yet to be described is a surfboard that keeps the clear benefits of inflatable surfboards in Category II and enables high performance surfing with accurate duplication of surfboard shapes. Surfboard performance determines the level of surfing ability a given board will support. For example, without limitation, performance influences what surfing maneuvers can be executed and how well these maneuvers can be done. Performance also influences what kind of waves can be optimally ridden. The present disclosure is concerned with shape and weight and does not discuss the effects of fins on performance. In general, low weight is taken as a positive trait in surfboard performance and Category II surfboards supply this trait. However, shape, by far, has the greatest effect on performance. The shape requirement entails that subtle details of surfboard shape must be captured.

FIG. 1 shows a perspective view of a typical prior art modern squash tail short board. The figure illustrates some of the complexity of shape surfboards can have. It cannot be emphasized enough that every part of a surfboard shape influences handling characteristics and performance. Take as an example the "rocker" of a surfboard. The rocker describes the long axis curves that reaches from a nose 15 to a tail 16 of the board along the outer surface 17 underside 20 and a top deck 18. The rocker has a large influence on board performance.

The template of a surfboard, which is the shape outline as viewed from above, is also essential in defining surfboard performance characteristics. FIG. 2A, FIG. 2B, and FIG. 2C illustrate top views of exemplary prior art surfboards to illustrate the templates of these surfboards. FIG. 2A shows a typical squash tail short board, FIG. 2B shows a typical long board, and FIG. 2C shows a fish. From this top view, top deck 18 with outer surface 17 is illustrated comprising a left rail 19L and a right rail 19R, nose 15, tail 16, and a centerline 14. Each template is tailored to address certain styles of surfing, types of waves, and surfing skill levels.

In addition to the long axis curves of a surfboard are the short axis curves from right rail 19R to left rail 19L along underside 20. They are known as "vee" or "concave" depending on the shape. These curves change from the nose to the tail and exhibit great variation in shape depending on what performance characteristics are desired. FIG. 3A through FIG. 3H illustrate some common shapes with surfboard cross-sections taken near a middle section and a tail section of representative prior art surfboards. FIGS. 3A and 3B show middle and tail cross sections, respectively, of a short board with a "flat to vee" configuration. This setup emphasizes acceleration, speed and control. FIGS. 3E and 3F show middle and tail cross sections, respectively, of a big wave gun with a "triplane to vee" configuration. This shape is designed to perform at high speed in extreme conditions. FIGS. 3C and 3D show middle and tail cross sections, respectively, of a typical longboard configuration. FIGS. 3G and 3H show middle and tail cross sections, respectively, of a short board with a single to double concave configuration. This design provides more lift and acceleration through turns amongst other performance characteristics. These figures highlight the variability and complexity of short axis curves on surfboards. Another important component of these curves is along rails 19L and 19R. Rails 19L and 19R tend to have a soft edge near the front and middle of the surfboard for penetrating the face of the wave and facilitating easy transition from rail to rail. However, near the tail they tend to have a sharper edge for leverage and release when accelerating out of turns.

FIG. 4A and FIG. 4B show side views of exemplary prior art surfboards. FIG. 4A illustrates the short board also shown by way of example in FIG. 1, and FIG. 4B shows the eight-foot long board also shown by way of example in FIG. 2B. These figures dramatically illustrate the surfboard rocker. Surfboard shapers even identify sub-portions of the long axis curves of a surfboard as a nose rocker, a tail rocker, an entry rocker, a deck rocker and a rail rocker, each of which can be altered to change surfboard-handling characteristics. The nose rocker describes the curves from near a point 21 to the tip of nose 15. The tail rocker describes the curves from near a point 22 to the tip of tail 16. The deck rocker runs along deck 18 from nose 15 to tail 16. The entry rocker and the rail rocker run along underside 20. However, the rail rocker is the curve along rails 19L and 19R, while the entry rocker describes the curves closer to a centerline 14 starting near the front of the surfboard but behind point 21. These aspects of shape are vital to surfboard performance. Finally, it is notable that even the short axis contours of top deck 18 and foil are considerations in surfboard performance. The foil is the distribution of the thickness throughout a surfboard.

The interaction of rocker, template, vee or concave, foil and deck contours can lead to fairly complex curved surfaces on the surfboard outer surface 17 top deck 18 and underside 20. Small changes in these surfaces, especially underside 20 can cause significant changes in performance. Previous inflatable surfboards do not claim to enable high performance surfing but only claim that their inventions could be used for skilled surfing. They make no attempt to describe how one can accurately capture complex curvature and shape details.

In view of the foregoing, there is a need for an improved surfboard that incorporates durability, safety and transportation considerations and is able to be constructed to accurately capture the complex curves and shape details of high-performance surfboards.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 3A and 3B show middle and tail cross sections, respectively, of a short board with a flat to vee configuration. FIGS. 3E and 3F show middle and tail cross sections, respectively, of a big wave gun with a triplane to vee configuration. FIGS. 3C and 3D show middle and tail cross sections, respectively, of a typical longboard configuration. FIGS. 3G and 3H show middle and tail cross sections, respectively, of a short board with a single to double concave configuration;

FIG. 4A illustrates the short board also shown by way of example in FIG. 1, and FIG. 4B shows the eight-foot long board also shown by way of example in FIG. 2B;

FIG. 7 illustrates a method of attaching fins directly to the outer layer of the surfboard. FIG. 8 illustrates a method using fin box supports. FIG. 9 illustrates a method using a fin box support structure;

FIG. 11A shows the housing with a rigid structure, and FIG. 11B shows housing after rigid structure is removed;

SUMMARY OF THE INVENTION

Figure 1:
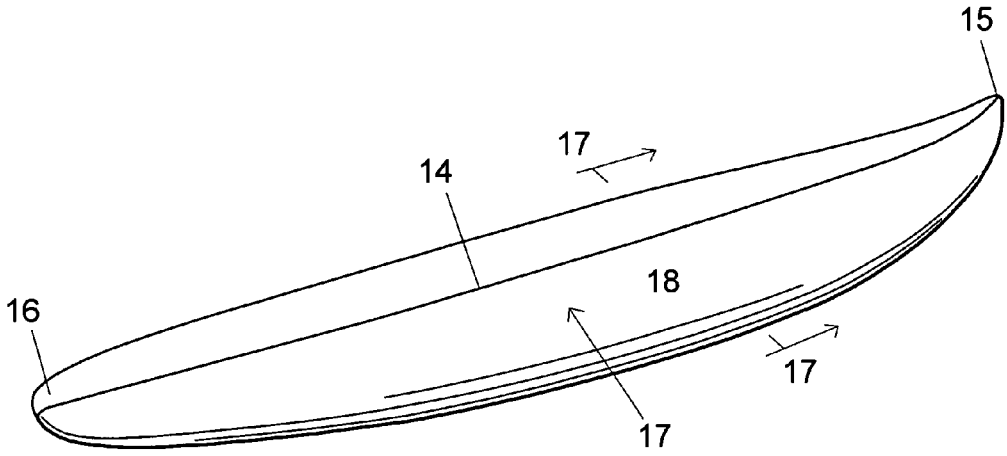
Fig. 1 Prior Art
FIG. 1 shows a perspective view of a typical prior art modern squash tail short board.
Figure 2A:
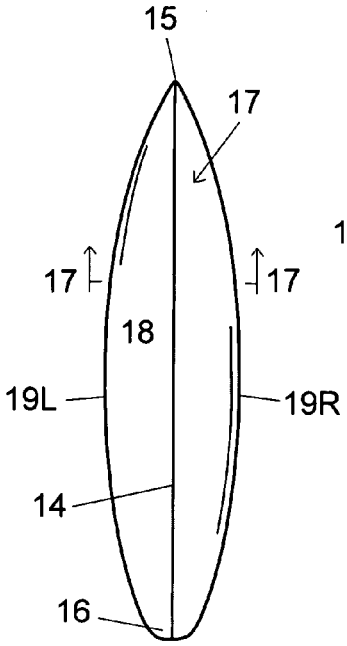
Fig. 2A Prior Art
FIG. 2A, FIG. 2B, and FIG. 2C illustrate top views of exemplary prior art surfboards to illustrate the templates of these surfboards.
Figure 2B:
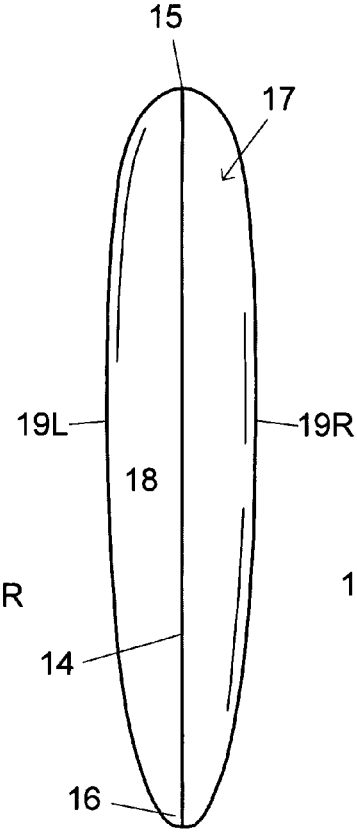
Fig. 2B Prior Art
Figure 2C:
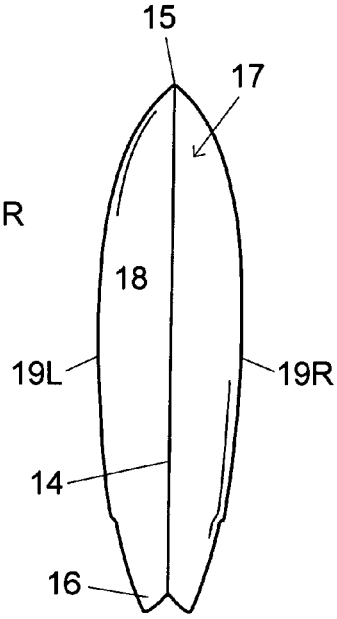
Fig. 2C Prior Art
Figure 3A:
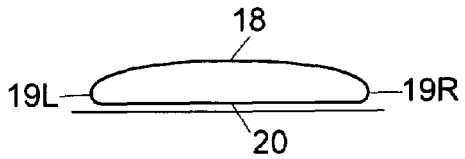
Fig. 3A Prior Art
FIG. 3A through FIG. 3H illustrate some common shapes with surfboard cross-sections taken near a middle section and a tail section of representative prior art surfboards.
Figure 3B:
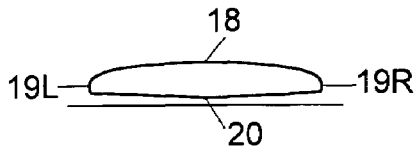
Fig. 3B Prior Art
Figure 3C:
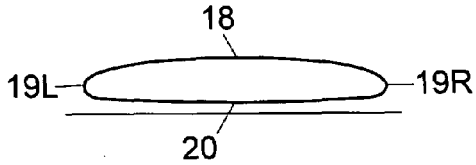
Fig. 3C Prior Art
Figure 3D:
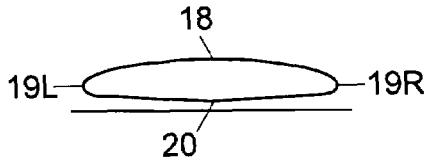
Fig. 3D Prior Art
Figure 3E:
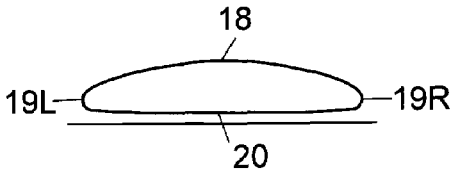
Fig. 3E Prior Art
Figure 3F:
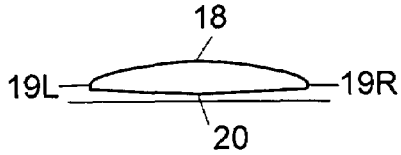
Fig. 3F Prior Art
Figure 3G:
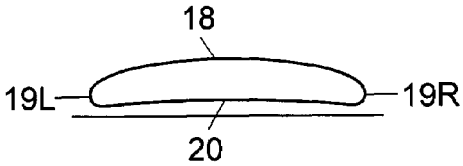
Fig. 3G Prior Art
Figure 3H:
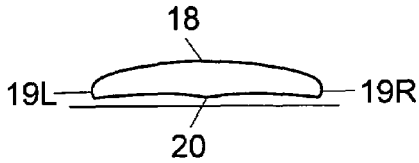
Fig. 3H Prior Art
Figure 4A:
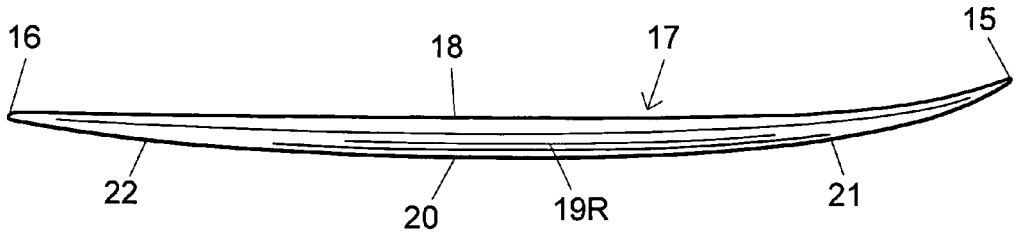
Fig. 4A Prior Art
FIG. 4A and FIG. 4B show side views of exemplary prior art surfboards.
Figure 4B:
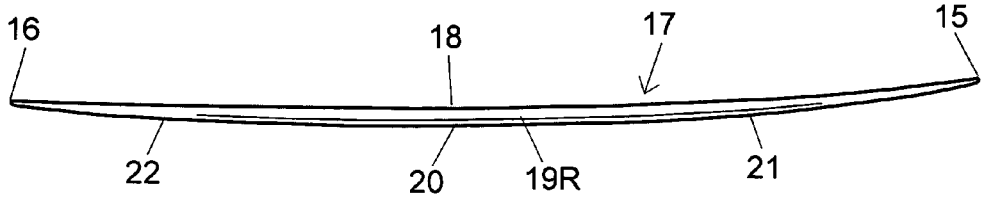
Fig. 4B Prior Art

To achieve the forgoing and other objects and in accordance with the purpose of the invention, a shaped inflatable water sports board is presented.

In one embodiment, an inflatable water sports board includes an airtight elongated housing having a predetermined shape, an internal structure contained within the housing for substantially maintaining the predetermined shape when the board is inflated, and an inflation valve for inflating the board where when the board is inflated the board is sufficiently rigid to maintain the predetermined shape under the weight of an adult. In other embodiments, the inflatable water sports board the internal structure includes a foam type material and drop-stitching passing through the material at regular intervals might be used. Another embodiment further includes a reinforcing layer surrounding the material and the drop-stitching passes through the layer. In yet another embodiment, the material is rigid and is removed from the layer before being contained in the housing. In yet other embodiments, the internal structure includes a plurality of cross-sectional pieces attached end-to-end and cross-sectional supports might be sandwiched in between the cross-sectional pieces. In still another embodiment, the inflatable water sports board further includes one or more fins attachable to an underside of the housing. Another embodiment includes one or more fin boxes positioned in the internal structure for receiving a portion of the one or more fins for attachment to the housing. Yet another embodiment includes one or more fin box supports contained within the housing in which the one or more fin boxes or the one or more fins are inserted. In a further embodiment, the fin box support is adapted to receive a plurality of fin boxes or fins.

In another embodiment an inflatable water sports board includes means for providing an airtight elongated housing, means for providing an internal structure, and means for inflating the board. A further embodiment includes means for providing one or more fins.

In another embodiment an inflatable surfboard is presented The inflatable includes a flexible airtight housing having a predetermined shape, a flexible internal structure contained within the housing for substantially maintaining the predetermined shape when the surfboard is inflated, the internal structure being sufficiently collapsible for transportation and storage, an inflation valve positioned on a top the of the surfboard for inflating the surfboard where when the surfboard is inflated the surfboard is sufficiently rigid to maintain the predetermined shape under the weight of an adult when the surfboard is in use, and one or more fins attachable to an underside of the surfboard for changing the performance of the surfboard when in use. A further embodiment includes one or more fin boxes positioned in the internal structure for receiving a portion of the one or more fins for attachment to the surfboard. Another embodiment includes one or more fin box supports contained within the surfboard in which the one or more fin boxes or the one or more fins are inserted. Yet another embodiment includes a fin box support structure positioned in a tail end of the surfboard and adapted to receive a plurality of fin boxes or fins. In another embodiment the internal structure comprises a foam type material and drop-stitching passing through the material at regular intervals. Another embodiment further includes a reinforcing layer surrounding the material where the drop-stitching passes through the layer. In yet another embodiment, the internal structure comprises a plurality of cross-sectional pieces attached together to form the predetermined shape.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternatives embodiments do not necessarily imply that the two are mutually exclusive.

The present invention will now be described in detail with reference to embodiments thereof as illustrated in the accompanying drawings.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A precisely shaped inflatable water sports board is disclosed by embodiments of the present invention. No previous work has addressed the need for precise shape capture when creating an inflatable surfboard. By precisely duplicating the shape characteristics of modern surfboards in embodiments of the present invention, high performance can be achieved in an inflatable surfboard. Practically any surfboard shape can be duplicated. A representative sample of surfboard shapes are shown in FIGS. 1 through 4. Important cross-sectional shape details are indicated in FIG. 3. Enabling high performance lends inflatable surfboards to wider use by members of the surfing community, many of whom desire the advantages of previous inflatable surfboards such as, but not limited to, transportability, durability and safety, and also desire performance.

In a general embodiment of the present invention, the surfboard comprises an airtight elongate housing that accurately conforms to a particular surfboard shape upon inflation and becomes sufficiently rigid to hold this shape under the weight of an adult surfer. A flexible support structure throughout the interior of the housing enables the surface of the surfboard to retain the desired shape upon inflation. Optimally, the flexible support structure is light for performance, porous to air, and sufficiently collapsible for transportability and storage. An inflation valve is mounted on the housing, preferably on the top deck so as not to interfere with the important shape details on the rails and the bottom surface of the surfboard. A variety of appropriate inflation valves are well known in the art for inflatable rafts, kayaks, boats and inflatable surfboards, such as, but not limited to, Halkey-Roberts inflatable boat valves, Leafield A-7, B-7 and C-7 inflation/deflation valves, Summit 1 and 2 valves and Nylon military valves. Valves are typically pressure fit to a boot. The boot can then be affixed to the housing by conventional means. Optionally, fins are affixed to the underside of the board depending on the embodiment. Generally, surfboards and windsurfing boards have fins while body boards generally do not.

Figure 5:
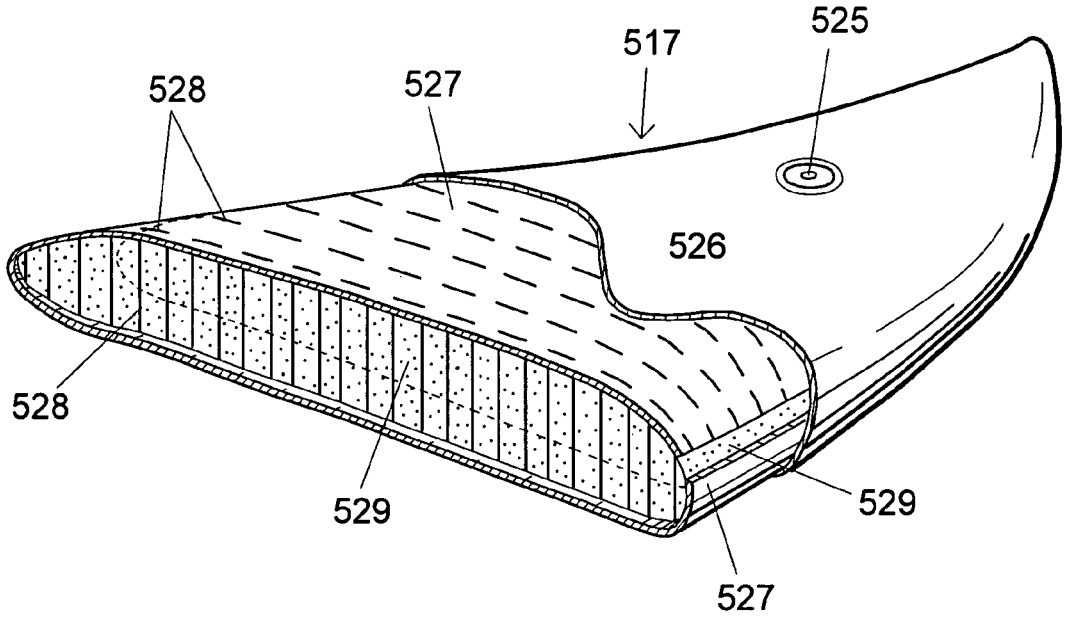
FIG. 5 illustrates a fragmentary perspective and cross-sectional view of an exemplary inflatable surfboard looking toward the front of the inflatable surfboard, in accordance with an embodiment of the present invention.

FIG. 5 illustrates a fragmentary perspective and cross-sectional view of an exemplary inflatable surfboard looking toward the front of the inflatable surfboard, in accordance with an embodiment of the present invention. The present embodiment is based on a typical short board shape as shown by way of example in FIGS. 1, 2A and 4A with cross section taken along line 17 in FIGS. 1 and 2A. However, alternate embodiments may take many various shapes for example, without limitation, any of the shapes illustrated in FIGS. 1 through 4, other surfboard shapes, body boards, windsurfing boards, etc. The inflatable surfboard comprises a housing 517, a flexible internal support structure 529, an inflation valve 525, and an airtight outer covering 526. Soft polyurethane foam is a good choice of material for internal support structure 529 because it is light, holds its shape, allows air to flow freely through its material matrix, and can be easily collapsed. Other flexible foams or material structures with similar properties can be used as well, such as, but not limited to, polyester, polyether, and viscoelastic polyurethane foams, Solomide® Polyimide foam, Basotect® Melamine foam and Omalon® foam. In order to enable surfing, housing 517 should be able to inflate until rigid enough to support a surfer. Furthermore, to maintain the performance characteristics of a given surfboard shape, the inflated housing 517 should be rigid enough so as not to bend out of shape during surfing (10-20 psi has been shown to be suitable but more may be necessary in some applications). Thus internal support structure 529 must be able to hold together under at least 10-20 psi. If internal support structure 529 cannot withstand this amount of pressure, as is the case for average polyurethane foam, additional flexible reinforcement, such as, but not limited to, drop-stitching 528, is required.

In the present embodiment, drop-stitching 528 comprises nylon thread, nylon string or nylon strips, and passes through internal support structure 529 at regular intervals along the length of the surfboard. The spacing between lines of drop-stitching 528 and along lines of drop stitching 528 can be varied depending on the amount of support needed. Depending on the thickness of drop-stitching 528 and anticipated inflation housing 517 inflation pressure, a flexible reinforcing layer 527 may be necessary. Flexible reinforcing layer 527 generally prevents drop-stitching 528 from cutting into the soft internal support structure 529 and pulling away from outer covering 526 upon inflation. Suitable materials for flexible reinforcing layer include, without limitation, Hypalon® or Neoprene® fabrics, nylon fabrics and canvas. As in previous inflatable water sports boards, drop-stitching 528 can be applied in a multitude of patterns to achieve the same result, for example, without limitation, zig-zag, from surfboard nose to tail, or from surfboard side rail to the opposite side rail. Flexible reinforcing layer 527 can be affixed to internal support structure 529 in various ways before flexible reinforcement is applied such as, but not limited to, gluing, or as discussed later, during the internal support structure 529 creation (taking advantage of the adhesive properties of urethanes). Also, it is contemplated that the flexible reinforcement (drop stitching) itself can serve to affix flexible reinforcing layer 527.

The flexible, airtight material, which forms outer layer 526 of inflatable elongate housing 517 can be constructed by conventional means well known to those skilled in the art and adheres (through gluing or chemical bonding) strongly to flexible reinforcing layer 527 or internal support structure 1029. Coated fabrics such as, but not limited to, Hypalon® or Neoprene® and plastic polymers like PVC or urethane make especially good choices for outer layer 526 because of their long history of use in inflatable rafts and boats. Outer layer 526 may also be sprayed directly on flexible reinforcing layer 527 depending on the material used.

In typical use, a surfer uses inflation valve 525 to inflate housing 517 of the inflatable surfboard. This is preferably done with an air pump such as, but not limited to, a foot pump or a compressor; however, the surfer may inflate the inflatable surfboard by mouth when no pump is accessible and when only low pressure is desired (e.g. for safety at the price of performance). In some embodiments, housing 517 may be self-inflating. The surfer inflates housing 517 until it is rigid. Then, the surfer closes inflation valve 525 to keep the air in housing 517. The surfer can then surf on the surfboard just as he would on a conventional surfboard. When the surfer is finished, he may deflate the surfboard by opening inflation valve 525 to let the air out of the surfboard. When deflated, the surfboard can be folded, rolled-up, or otherwise compressed to fit into a much smaller area than a conventional surfboard.

Figure 6:
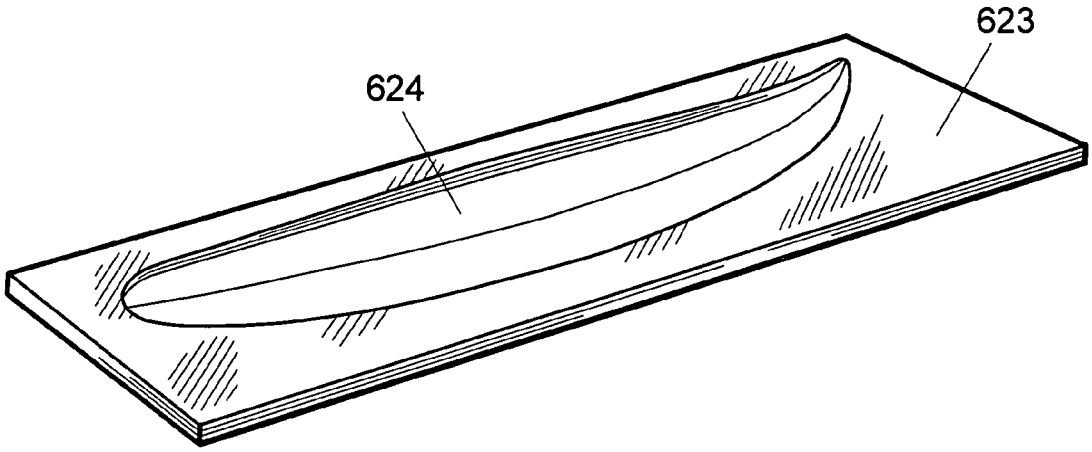
FIG. 6 illustrates the lower half of an exemplary mold taken of a short board shape as shown by way of example in FIG. 1 and used to form an inflatable surfboard, in accordance with an embodiment of the present invention.

FIG. 6 illustrates the lower half of an exemplary mold 623 taken of a short board shape as shown by way of example in FIG. 1 and used to form an inflatable surfboard, in accordance with an embodiment of the present invention. Mold 623 is used in the construction of the preferred embodiment of the present invention. Although the methods of mold making are well known to those skilled in the art, showing an example specific to an embodiment of the present invention aids in understanding the construction of the preferred embodiment. In the present embodiment, an original shaped and finished surfboard of the desired shape is used to make high tolerance mold 623. Many well known molding materials and methods can be used to create this mold such as, but not limited to, casting, vacuum forming, and computer based mold creation. Mold 623 is used to create flexible internal support structure 529 for the surfboard, shown by way of example in FIG. 5. In the preferred embodiment, a version of the original shape is formed as internal support structure 529 from a soft foam material, for example, without limitation, soft polyurethane foam. Before the soft foam casting is created, a top inner surface (not shown) and a bottom inner surface 624 of high tolerance mold 623 may be covered in the material used to form flexible reinforcing layer 527, shown by way of example in FIG. 5. When the foam of internal support structure 529 rises to fill mold 623, the foam adheres to flexible reinforcing layer 527 automatically. When the foam casting is removed, flexible reinforcing layer 527 is already coating the soft foam casting that forms internal support structure 529. This is due to the natural adherent properties of polyurethanes. Alternatively, a soft foam casting can be made, and after the casting is removed from the mold, flexible reinforcing layer 527 may be adhered, as previously discussed, by gluing or drop-stitching directly. In another alternate embodiment shown if FIG. 10, no flexible reinforcing layer is needed, so after casting, internal support structure 529 is removed from mold 623, and outer layer 526 is adhered directly to internal support structure 529, for example by gluing, chemical bonding or heat bonding as appropriate.

Figure 7:
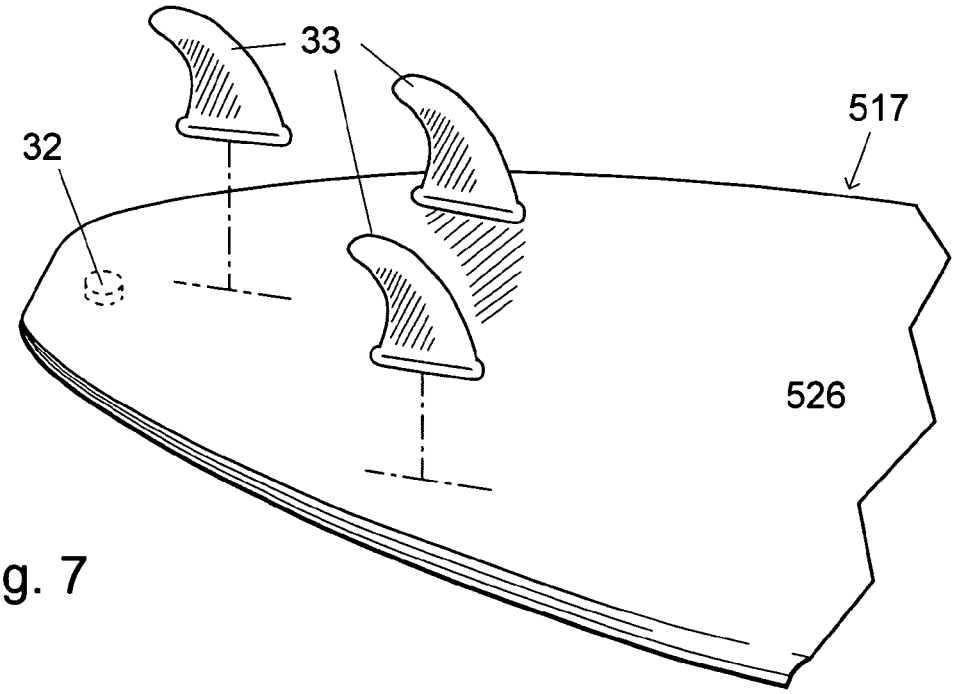
FIGS. 7, 8 and 9 illustrate exemplary methods for attaching fins to an inflatable surfboard, in accordance with embodiments of the present invention.
Figure 8:
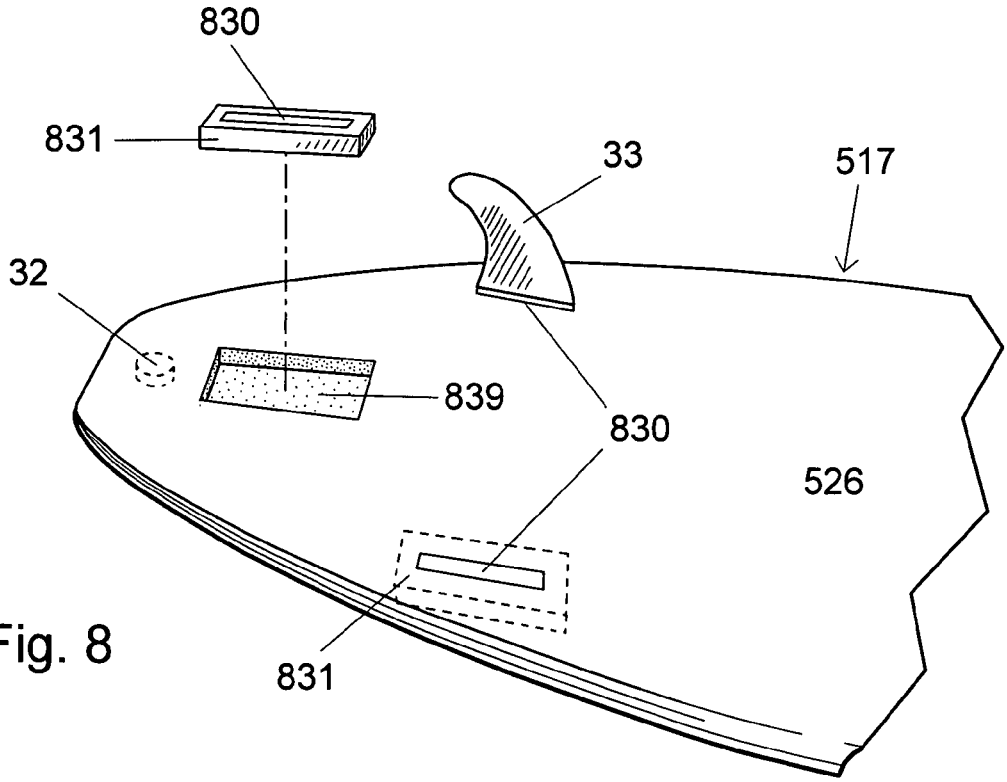
Figure 9:
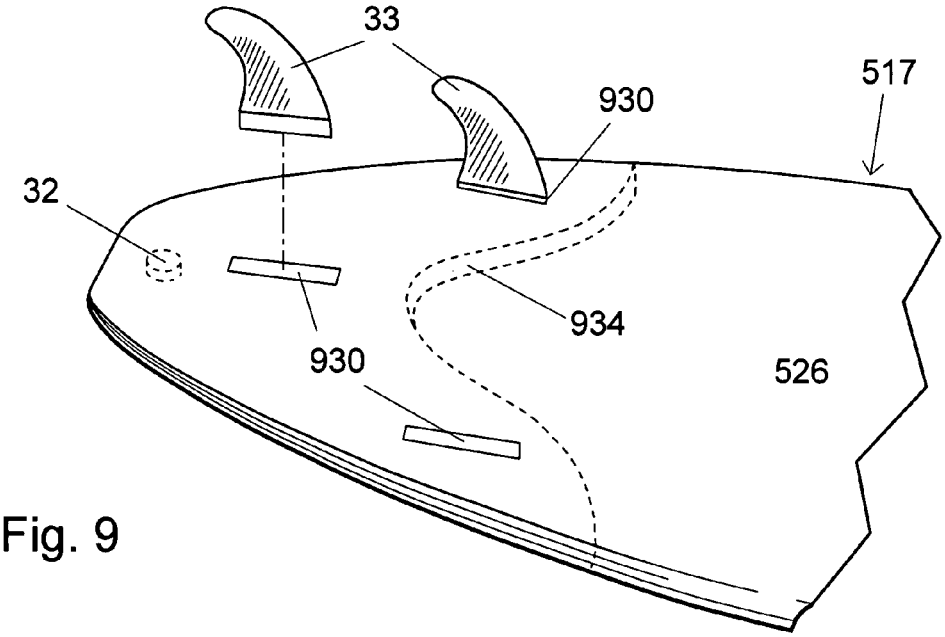

Some embodiments of the present invention include fins 33 on the underside of the surfboard. Fins 33 can change the performance of the surfboard, and fins 33 may come in various shapes and sizes depending on the performance needs of the particular surfboard. Fins 33 may be attached in a plurality of ways. FIGS. 7, 8 and 9 illustrate exemplary methods for attaching fins 33 to an inflatable surfboard, in accordance with embodiments of the present invention. FIG. 7 illustrates a method of attaching fins 33 directly to outer layer 526 of the surfboard. FIG. 8 illustrates a method using fin box supports 831. FIG. 9 illustrates a method using a fin box support structure 934. The simplest method, shown by way of example in FIG. 7, is to affix fins 33 directly to outer layer 526. Methods to accomplish this are known to those skilled in the art such as, but not limited to, gluing, pressure fitting with a boot and heat or chemical bonding.

In an alternate embodiment, fin boxes 830 and fin box supports 831 are used as indicated by way of example in FIG. 8. Fin boxes 830 or fins 33 directly are inset into fin box supports 831. Fin box supports 831 fit into fin insets 839. Fin box supports 831 are rigid, lightweight and strong and are not collapsible. Various hard plastic or rubber structures are suitable. The additional rigid support helps stabilize fins 33 when the board is inflated. If fin boxes 830 are not well supported, fin boxes 830 may flex too much under forces acting on fins 33 when surfing, thereby compromising the performance of the surfboard. There is a tradeoff with using rigid supports because fins 33 are stabilized at the price of housing 517 no longer being fully collapsible. However, this only affects the tail portion of the surfboard, which is a small thin area.

In the present embodiment, insets 839 for fin box supports 831 are cut into the interior soft foam support structure or alternatively introduced in the molding process as raised portions of the mold that form a negative imprint when a soft foam casting is made. Fin box supports 831 are installed before application of outer layer 526 or flexible reinforcing layer 527, shown by way of example in FIG. 5. The seam between these layers and fin box supports 831 is sealed to be airtight by methods common in the art such as, but not limited to using a sealant or glue, pressure fitting and heat or chemical bonding. Fin box supports should be anchored in insets 839 so that no bulging and therefore shape deformation (which would hinder performance) occurs under inflation pressure in the housing 517. In some embodiments, fin box supports 831 may be secured in insets 839 by various means such as, but not limited to, gluing and/or mechanical means For instance, drop stitching 528 may pass through fin box supports 831 to secure it in place. Inset 839 is shown for the center fin of a three-fin thruster configuration. The other two fin boxes 830 are similarly inset; however, the insets are not shown.

In an alternate embodiment, shown by way of example in FIG. 9, a rigid fin box support structure 934 supports fin boxes 930 with fins 33. In the present embodiment, the fin box support is expanded to encompass the entire tail area of elongate inflatable housing 517. This expanded structure provides more fin support and also serves to define the edge of the rails that are often sharper near the tail of the surfboard. Maintaining the integrity of this edge positively impacts surfboard performance.

For each of these alternative methods there may be one, two, three or even more fins as necessary, depending on the surfboard design. Many configurations of fins and fin boxes are commonly available for use in surfboards. Preferably, fins should be easily removable to aid in efficient storage and transport. Removable fins are standard in the surfboard industry. For example without limitation, the fins may be shaped to be able to snap into and out of the fin boxes. An inset 32 for a surf leash plug is indicated in its standard position near the tail of the surfboard in FIGS. 7, 8 and 9. Plug 32 can be installed similarly to the fin box support structures or adhered to outer layer 526.

Figure 10:
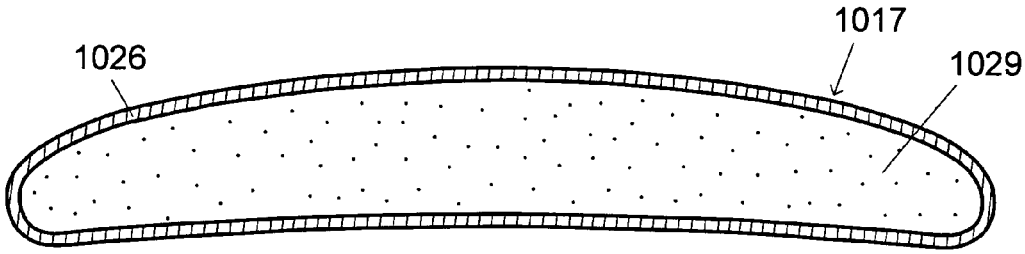
FIG. 10 illustrates a cross sectional view of an exemplary inflatable surfboard without a flexible reinforcing layer or additional flexible reinforcement, in accordance with an embodiment of the present invention.

FIG. 10 illustrates a cross sectional view of an inflatable surfboard without a flexible reinforcing layer or additional flexible reinforcement, in accordance with an embodiment of the present invention. In the present embodiment, an airtight flexible outer surface 1026 is applied directly to a soft internal support structure 1029 of housing 1017. This embodiment is suitable when internal support structure 1029 is strong enough to maintain structural integrity under inflation pressures that will rigidify the surfboard enough to hold the weight of an adult surfer and maintain performance. As mentioned previously, appropriate performance can be achieved by retaining surfboard shape under the forces applied from inflation and from the rider while surfing. Materials that may be suitable for internal support structure 1029 are the same as those used for internal support structure 529, and include without limitation, polyester, polyether, and viscoelastic polyurethane foams, Solomide® Polyimide foam, Basotect® Melamine foam and Omalon® foam. Again, the suitability of any of these materials depends on the ability to hold structural integrity under inflation. The present embodiment is easier to construct because it has fewer layers and less reinforcement, which entails fewer steps in the construction process. It should be noted that if internal support structure 529 is sufficiently strong to withstand this pressure, outer covering 526 can be applied directly to internal support structure 529 as shown, by way of example, in FIG. 10 without drop-stitching.

Figure 11A:
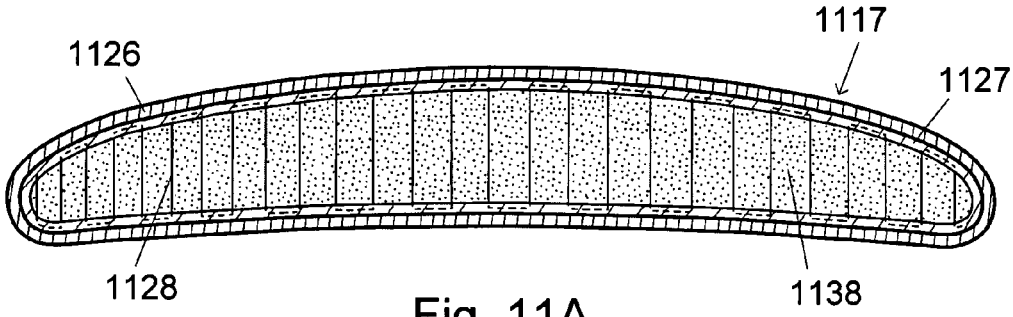
FIGS. 11A and 11B illustrate cross sectional views of an exemplary inflatable surfboard where a housing is constructed by alternate means, in accordance with an embodiment of the present invention.
Figure 11B:
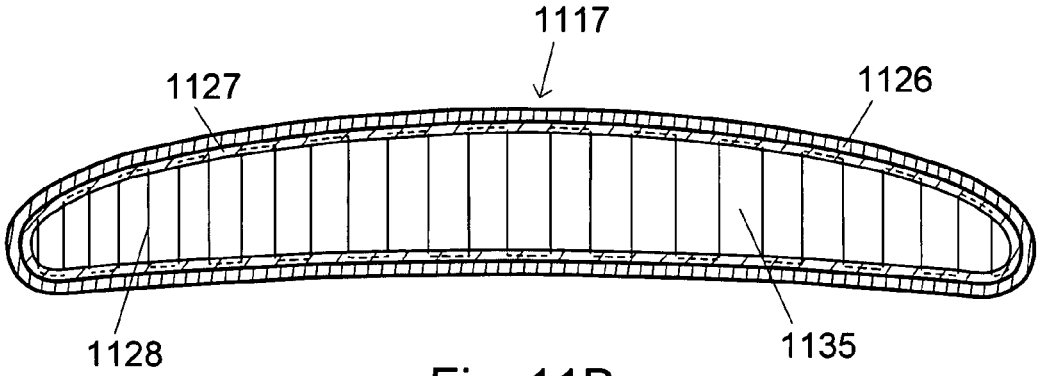

FIGS. 11A and 11B illustrate cross sectional views of an inflatable surfboard where a housing 1117 is constructed by alternate means, in accordance with an embodiment of the present invention. FIG. 11A shows housing 1117 with a rigid structure 1138, and FIG. 11B shows housing 1117 after rigid structure 1138 is removed. In the present embodiment, instead of using a flexible internal support structure, for example, without limitation, internal support structure 529 shown in FIG. 5 that captures shape details and is integrated into the resultant surfboard, a rigid structure 1138 is used to capture shape details. Flexible reinforcement is added in the form of drop-stitching 1128. Drop-stitching 1128, a flexible reinforcing layer 1127, and a flexible airtight outer layer 1126 are applied as discussed by way of example in accordance with FIG. 5. Then, rigid structure 1138 is removed before the final sealing of housing 1117. The final step is shown by way of example in FIG. 11B with the surfboard in the inflated state, where only air 1135 and drop-stitching 1128 remain in the interior of housing 1117. An advantage of using this form of construction is that housing 1117 is lighter and more fully collapsible. Fins and/or fin boxes and fin box supports may be installed as described in accordance with FIGS. 7 through 9. To facilitate removal of rigid structure 1138, rigid structure 1138 is preferably comprised of a material that can either be easily crushed or dissolved such as, but not limited to, extruded polystyrene manufactured as wetfoam and other polystyrene foam variants, some or all of which may not be suitable for certain applications as will be clear to those skilled I the art. In alternate embodiments, the rigid structure may not be collapsible.

Flexible internal support structure 529, shown by way of example in FIG. 5, internal support structure 1029, shown by way of example in FIG. 10, and rigid structure 1138 can be shaped into a target surfboard shape in many ways. For materials that can be cast, such as, but not limited to, soft polyurethane foam the techniques of mold making can be employed. Other materials, like extruded polystyrene foam can be shaped by hand. In some techniques, the original surfboard shape can be scanned into a computer and used to control a cutting machine that duplicates the desired shape. These are all known techniques in the surfboard industry. Another simple method is illustrated by way of example in FIG. 12.

Figure 12:
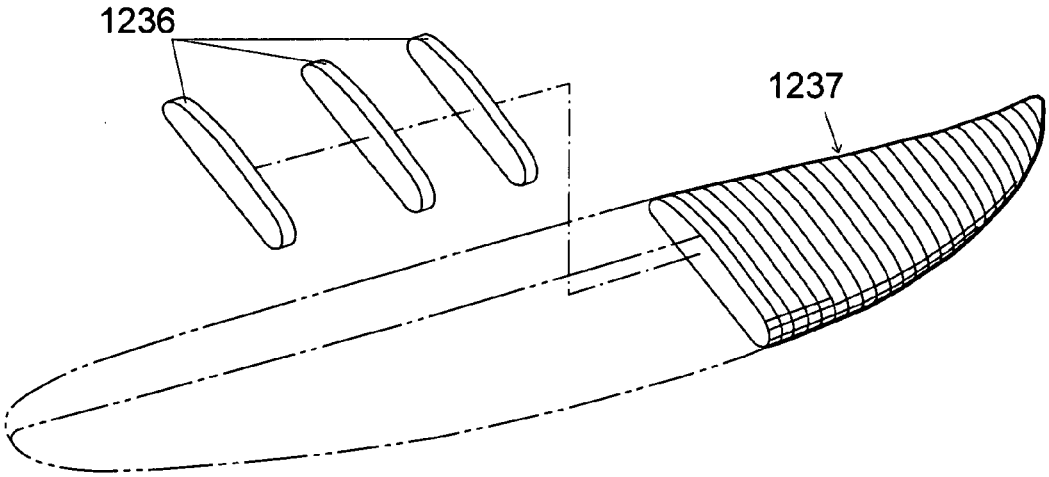
FIG. 12 illustrates a perspective view of cross sections used in a exemplary method of shaping an internal support of an inflatable surfboard, in accordance with an embodiment of the present invention.

FIG. 12 illustrates a perspective view of cross sections 1236 used in a method of shaping an internal support structure 1237 of an inflatable surfboard, in accordance with an embodiment of the present invention. In the present embodiment, cross sections 1236 taken at appropriate intervals along the desired shape are measured and cut out of the target material and then assembled end to end to form the final shape of internal support 1237. In the present embodiment, cross sections 1236 are affixed to each other with glue; however, in alternate embodiments other means for attachment may be used such as, but not limited to, stitching. Using cross sections 1236 simplifies manufacturing by avoiding molds and other complex machinery. All that is necessary are measured cross-sectional templates and a sheet of prefabricated material, for example, without limitation, soft polyurethane foam, from which to cut out the desired shapes. Cross sections 1236 can be taken along either the long or the short axis of the surfboard. Cross sections 1236 should preferably be sufficiently thin to accurately capture shape details.

Figure 13:
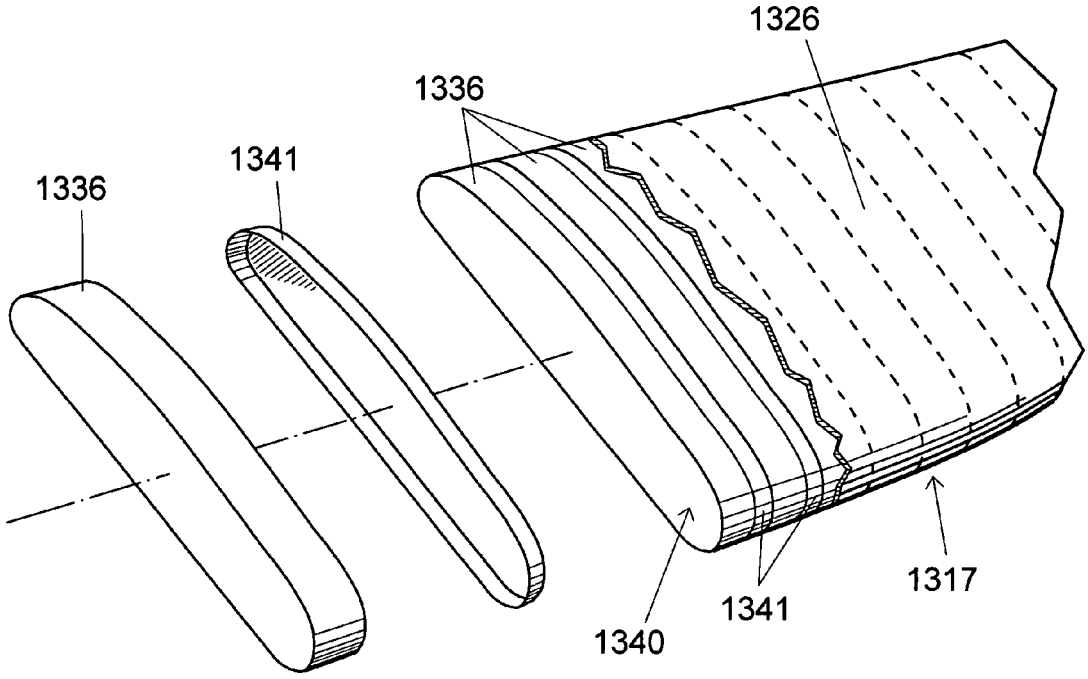
FIG. 13 illustrates a perspective view of cross sections and flexible cross-sectional supports used in a method of shaping an internal support structure of a housing of an inflatable surfboard, in accordance with an embodiment of the present invention Unless otherwise indicated illustrations in the figures are not necessarily drawn to scale.

FIG. 13 illustrates a perspective view of cross sections 1336 and flexible cross-sectional supports 1341 used in a method of creating an internal support structure 1340 of a housing 1317 of an inflatable surfboard, in accordance with an embodiment of the present invention. In the present embodiment, measured cross-sections 1336 are used to construct alternative internal flexible support structure 1340. If cross sections 1336 are comprised of materials used for internal flexible support structure 529 or 1029, for example, without limitation, soft polyurethane foam, cross sections 1336 may remain in the resultant surfboard and, depending on the material used, additional flexible cross-sectional supports 1341 is needed. Flexible cross-sectional supports serve the same purpose as previous methods of reinforcement such as drop stitching 528. They strengthen the flexible support structure (if necessary) enabling it to maintain material and shape integrity under inflation pressure. Flexible cross-sections can take any form that will accomplish this goal. In the present embodiment solid flexible cloth material that caps and is adhered to the end of measured cross-sections 1336 is used. Various materials are suitable for cross-sectional supports 1341 including, but not limited to, those used for construction of flexible airtight outer layer 1326. Cross sections 1336 are assembled and adhered end to end with flexible cross-sectional supports 1341 sandwiched in between cross sections 1336. Otherwise, construction proceeds as in previous embodiments.

In an alternate embodiment, cross-sections 1336 are rigid, and construction is preformed incrementally. In the present embodiment, a cross-section 1336 with flexible cross-sectional support 1341 capped over one end is put into position in relation to outer layer 1326 or other reinforcing layer. Flexible cross-sectional support 1341 is secured to the appropriate layer, for example, without limitation, outer layer 1326 or a flexible reinforcing layer as shown by way of example in FIG. 5, by conventional methods such as, but not limited to, sewing, gluing etc. Then, rigid-cross-section 1336 is removed and the next cross section 1336 is slid into position. Thereby, at the end of the process only flexible cross-sectional supports 1341 remain and the final sealing of housing 1317 and fin installation can be completed as previously described.

As previously mentioned, the techniques and methods described in the foregoing embodiments can be applied equally well to windsurfing boards and body boards. For windsurfing boards, some modifications are necessary to incorporate the mast, foot straps and other attachments. Body boards can be made using the methods as presented. In addition, these methods can be used to manufacture a great variety of inflatable items that require precise shape when inflated. Highly contoured inflatable rafts that better conform to body shape for use in a pool is one example. Another example is outdoor furniture that collapses and inflates into a desirable shape.

Having fully described at least one embodiment of the present invention, other equivalent or alternative means for implementing a precisely shaped inflatable sport board according to the present invention will be apparent to those skilled in the art. The invention has been described above by way of illustration, and the specific embodiments disclosed are not intended to limit the invention to the particular forms disclosed. The invention is thus to cover all modifications, equivalents, and alternatives falling within the spirit and scope of the following claims.

What is claimed is:

1. An inflatable water sports board comprising:

a flexible and collapsible airtight elongated housing comprising a predetermined shape substantially duplicating shape details of a performance surfing board, said substantially duplicated shape being achieved by properly configuring rockers, means for shaping underside short axis curves, rails, foil and top deck contours, whereby said substantially duplicated shape enables specific performance characteristics comprising a combination of handling, speed and maneuverability;

a flexible and collapsible internal structure contained within said housing for substantially maintaining said predetermined shape when said housing is inflated, said internal structure being shaped from dimensions of said predetermined shape and substantially filling said housing in whole or part, wherein said internal structure captures said shape details of said predetermined shape when said internal structure is constructed; and an inflation valve for inflating said housing where when the board is inflated the board is sufficiently rigid to maintain said predetermined shape under the weight of an adult.

2. The inflatable water sports board as recited in claim 1, in which said internal structure comprises a foam type material that allows air to flow freely through its material matrix and is sufficiently collapsible for transportation and storage.

3. The inflatable water sports board as recited in claim 2, in which said internal structure further comprises drop-stitching passing through said internal structure at regular intervals.

4. The inflatable water sports board as recited in claim 3, wherein said internal structure further comprises a flexible and collapsible reinforcing layer surrounding said internal structure and said drop-stitching passes through said layer.

5. The inflatable water sports board as recited in claim 4, in which said internal structure is constructed using a crushable material that is removed from said internal structure wherein said drop-stitching and reinforcing layer that remains maintains said captured shape details of said predetermined shape when the board is inflated.

6. The inflatable water sports board as recited in claim 1, in which said internal structure comprises a plurality of cross-sectional pieces joined end to end.

7. The inflatable water sports board as recited in claim 6, further comprising cross-sectional supports sandwiched in between said cross-sectional pieces, said supports being configured to be flexible and collapsible.

8. The inflatable water sports board as recited in claim 1, further comprising one or more fins attachable to an underside of said housing.

9. The inflatable water sports board as recited in claim 8, further comprising one or more fin boxes positioned in said internal structure for receiving a portion of said one or more fins for attachment to said housing.

10. The inflatable water sports board as recited in claim 9, further comprising one or more fin box supports contained within said housing to mitigate flexing of said one or more fin boxes during use of the board, and thereby preventing an associated decrease in surfboard control from said flexing.

11. The inflatable water sports board as recited in claim 10, in which said fin box support is adapted to receive a plurality of fin boxes or fins.

12. An inflatable water sports board comprising:

means for housing, said housing means comprising a predetermined shape substantially duplicating shape details of a performance surfing board upon inflation of said housing means;

means for internally maintaining said predetermined shape of said housing means; and means for inflating said housing means.

13. The inflatable water sports board as recited in claim 12, further comprising means for attaching one or more fins to said housing means.

14. An inflatable surfboard comprising:

a flexible and collapsible airtight housing comprising a predetermined shape substantially duplicating shape details of a performance surfboard, said substantially duplicated shape being achieved by properly configuring rockers, means for shaping underside short axis curves, rails, foil and top deck contours, whereby said substantially duplicated shape enables specific performance characteristics comprising a combination of handling, speed and maneuverability;

a flexible and collapsible internal structure contained within said housing for substantially maintaining said predetermined shape when said housing is inflated, said internal structure comprising a foam material shaped from dimensions of said predetermined shape and substantially filling said housing in whole or part, wherein said foam material captures said shape details of said predetermined shape when said material is constructed, allows air to flow freely through its material matrix and is sufficiently collapsible for transportation and storage;

an inflation valve positioned on a tap said of the surfboard for inflating said housing where when the surfboard is inflated the surfboard is sufficiently rigid to maintain said predetermined shape under the weight of an adult when the surfboard is in use; and one or more fins attachable to an underside of the surfboard for changing the performance of the surfboard when in use.

15. The inflatable surfboard as recited in claim 14, further comprising one or more fin boxes positioned in said internal structure for receiving a portion of said one or more fins for attachment to the surfboard.

16. The inflatable surfboard as recited in claim 15, further comprising one or more fin box supports contained within the surfboard in which said one or more fin boxes or said one or more fins are inserted.

17. The inflatable surfboard as recited in claim 14. further comprising a fin box support structure positioned in a tail end of the surfboard and adapted to receive a plurality of fins or fin boxes and fins where said fin box support structure mitigates flexing of said fins or fin boxes and fins during use of the surfboard, and thereby preventing an associated decrease in surfboard control from said flexing.

18. The inflatable surfboard as recited in claim 14, in which said internal structure further comprises drop-stitching passing through said internal structure at regular intervals.

19. The inflatable surfboard as recited in claim 18, wherein said internal structure further comprises a flexible and collapsible reinforcing layer surrounding said foam material where said drop-stitching passes through said layer.

20. The inflatable surfboard as recited in claim 14, in which said foam material comprises a plurality of cross-sectional pieces joined together to form said predetermined shape.

* * * * *